US007150479B2

(12) United States Patent
Benedict et al.

(10) Patent No.: US 7,150,479 B2
(45) Date of Patent: Dec. 19, 2006

(54) MODULAR THREAD CONNECTION WITH HIGH FATIGUE RESISTANCE

(75) Inventors: Detlev Benedict, Nienhagen (DE); Harald Düber, Vienenburg (DE); Helmut Flörke, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 10/314,704

(22) Filed: Dec. 9, 2002

(65) Prior Publication Data

US 2003/0156918 A1 Aug. 21, 2003

Related U.S. Application Data

(60) Provisional application No. 60/340,756, filed on Dec. 7, 2001.

(51) Int. Cl.
*F16L 25/00* (2006.01)

(52) U.S. Cl. ..... 285/333

(58) Field of Classification Search ..... 285/333, 285/334

See application file for complete search history.

(56) References Cited

U.S. PATENT DOCUMENTS

| | | | | |
|---|---|---|---|---|
| 3,067,593 A | | 12/1962 | McCool | |
| 3,079,181 A | * | 2/1963 | Van der Wissel | 285/333 |
| 3,917,319 A | | 11/1975 | Kloesel, Jr. et al. | |
| 4,549,754 A | * | 10/1985 | Saunders et al. | 285/334 |
| 4,588,213 A | * | 5/1986 | Bollfrass et al. | 285/333 |
| 5,127,784 A | | 7/1992 | Eslinger | |
| 5,221,113 A | * | 6/1993 | Stoll | 285/333 |
| 6,174,000 B1 | * | 1/2001 | Nishi et al. | 285/334 |
| 6,513,840 B1 | * | 2/2003 | Krug et al. | 285/334 |

FOREIGN PATENT DOCUMENTS

| | | |
|---|---|---|
| DE | 975291 | 11/1961 |
| EP | 0386373 | 12/1990 |
| WO | WO01/34936 | 5/2001 |

OTHER PUBLICATIONS

"Specification for Rotary Drilling Equipment," American Petroleum Institute (Aug. 1990).

* cited by examiner

*Primary Examiner*—David Bochna
(74) *Attorney, Agent, or Firm*—Maden, Mossman & Sriram, P.C.

(57) ABSTRACT

A connector for oilfield applications has high resistance against cyclical bending stress and fatigue failure. In a preferred embodiment, the threaded connector has a pin-box arrangement for joining two components. The pin and box have threads with a pre-determined profile different from that specified by conventional (e.g., API) specification and provide improved strength characteristics. Certain embodiments of the present invention include a pitch-to-root radius ratio that is less than that specified by the API, a thread height-to-root radius ratio that is less than that specified by the API, a flank angle that is less than that specified by the API, and a taper that is less than that specified by the API for said pre-determined outside diameter. Certain other embodiments have less than all of these ratios and dimensions. Optionally, the connector has (a) wiring for transmitting power and/or data through the connector; and (b) at least one seal disposed adjacent the wiring for protecting the wiring from contact with wellbore fluids.

28 Claims, 3 Drawing Sheets

MODULAR THREAD CONNECTION WITH HIGH FATIGUE RESISTANCE

CROSS-REFERENCE TO RELATED APPLICATIONS

This application takes priority from U.S. Provisional Patent Application Ser. No. 60/340,756, filed Dec. 7, 2001.

BACKGROUND OF THE INVENTION

Background of the Art

Threaded connections are a prevalent method to join two or more members such as pipe sections. In certain applications, as during hydrocarbon exploration and recovery operations, a string of pipe sections joined by threaded connections may be rotated in a well bore. For example, a drill string may be rotated to urge a bottomhole assembly into a subterranean formation. The bottomhole assembly (BHA) also may include components that are mated or joined with threaded connections. In certain instances, drilling activity may cause the string and BHA to bend. As is known, the bending of threaded connection induces compression on one side of the threaded connection and a tension on the other side of the threaded connection. Because the threaded connection is rotating, the tension and compression is cyclical. It is, of course, also known that cyclical bending stresses imposed by even moderate loadings may lead to failure of the threaded connection (e.g., high cycle fatigue).

The harsh drilling conditions of the well bore environment or deviated well bores can cause such cyclical bending stresses in these threaded connections. Unfortunately, conventional threaded connections, such as those specified by the American Petroleum Institute (API), do not always possess sufficient bending fatigue resistance to support advanced drilling programs or complex well bore trajectories. For example, in some instances, drilling operations and hydrocarbon recovery may require a highly deviated well bore, e.g., a well bore having a sharp radius portion. Form deviated wellbore sections requires a BHA and drill string that can withstand a relatively high "build-up rate." Conventional threaded connections subjected to such build-up rates can suffer reduced operational lifetime or require additional maintenance or rework. Moreover, even common drilling conditions slowly degrade conventional threaded connections such that these connections must be either changed-out or reworked. The costs incurred in such activity not only include the maintenance itself but, for example, the delay in drilling activities.

The present invention addresses these and other drawbacks of conventional threaded connections.

SUMMARY OF THE INVENTION

The present invention provides a threaded connection having high resistance against cyclical bending fatigue. In a preferred embodiment, the threaded connection is used in a pin-box arrangement that joins two drill string components. Such components include, but are not limited to, steerable assemblies, drilling motors, bottomhole assemblies, measurement-while-drilling assemblies, formation evaluation tools, drill collars or drill pipe. In addition to complementary threads, the pin and box each include a radial shoulder and abutting surface, respectively. The threads of the pin and box conform to a pre-determined profile that is defined at least by taper, pitch, and root radius. A preferred thread profile includes a relatively long pitch, a relatively large root radius and a relatively shallow taper as compared to conventional thread profile standards (e.g., API standards). The thread configuration is defined at least by pre-determined reference diameters, a pin length, and a boreback-diameter. An illustrative thread profile for an exemplary 9½ inch connection or coupling provided on preferred components is approximately as follows: Taper: 1:5; a ratio between Pitch and Root Radius (P/R) of approximately 5.40; and a ratio between Thread Height and Root Radius (H/R) of approximately 2.41. It should be appreciated that these values are provided with specificity merely for convenience and that the present invention is by no means limited to these values. Moreover, a coupling having less than all of these characteristics may provide adequate performance in many applications. It is believed that this exemplary joint will have a pin bending strength that is fifty percent greater and a box bending strength that is one hundred percent greater than a conventional threaded connection for the same size joint.

In certain embodiments to the present invention, the threads may be cold worked to increase of fatigue resistance, copper plated to increase of galling resistance, and/or shot peened to increase resistance against stress-corrosion-cracking. The threads may also include stress relief groove(s) to increase of fatigue resistance. The threaded connection can optionally include a contact ring in the shoulder to transmit power and data between different tools. In still another embodiment, the threaded connection includes a sealing system to avoid mud ingress and electrical shortage under rough drilling conditions. The threaded connection of the present invention increases the mechanical strength of conventional joined components and thus enhances the allowable operational range (e.g., rotating Build-up-Rate capacity), increases service reliability in case of harsh drilling conditions, and also reduces maintenance costs.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
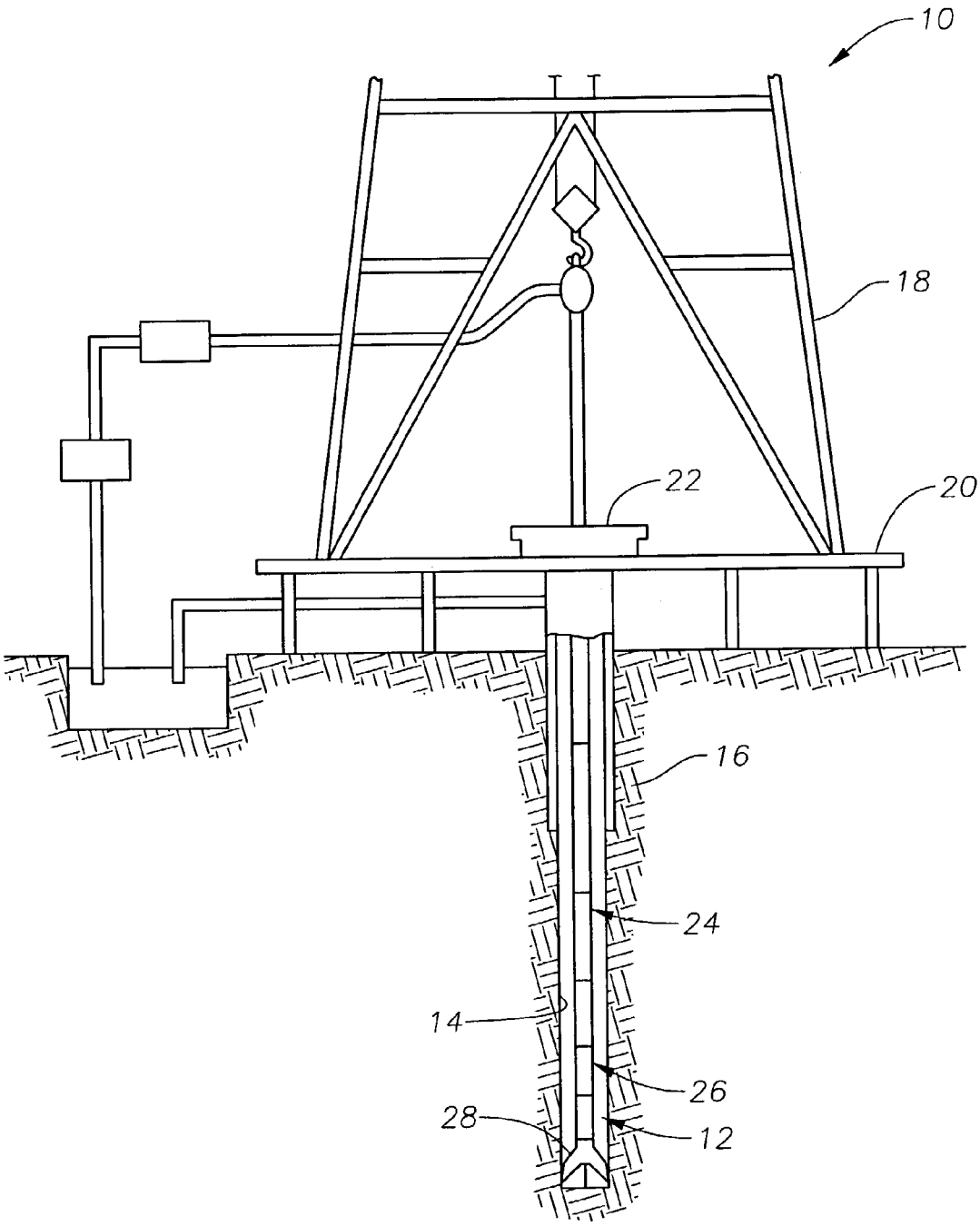
FIG. 1 shows a schematic diagram of a well construction system with a bottom hole assembly utilizing the threaded connection of the present invention.

The present invention relates to an apparatus and methods for increasing the fatigue resistance of pin and box connections or couplings subjected to cyclic bending stresses, particularly in oilfield applications. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1 there is shown a schematic diagram of a well construction system 10 having one or more well tools 12 shown conveyed in a borehole 14 formed in a formation 16. The system 10 includes a conventional derrick 18 erected on a floor 20 that supports a rotary table 22 that is rotated by a prime mover such as an electric motor (not shown) at a desired rotational speed. A string 24, such as a tool string, work string, or drill string, extends downward from the surface into the borehole 14. The string 24 and well tool 12 can include any type of equipment including a steerable drilling assembly, a drilling motor, measurement-while-drilling assemblies, formation evaluation tools, drill collars or drill pipe. For simplicity, a bottomhole drilling assembly (BHA) 26 is showing having a drill bit 28 and attached to the end of the drill string 24. The bit 26 is adapted to disintegrate a geological formation when rotated.

Figure 2:
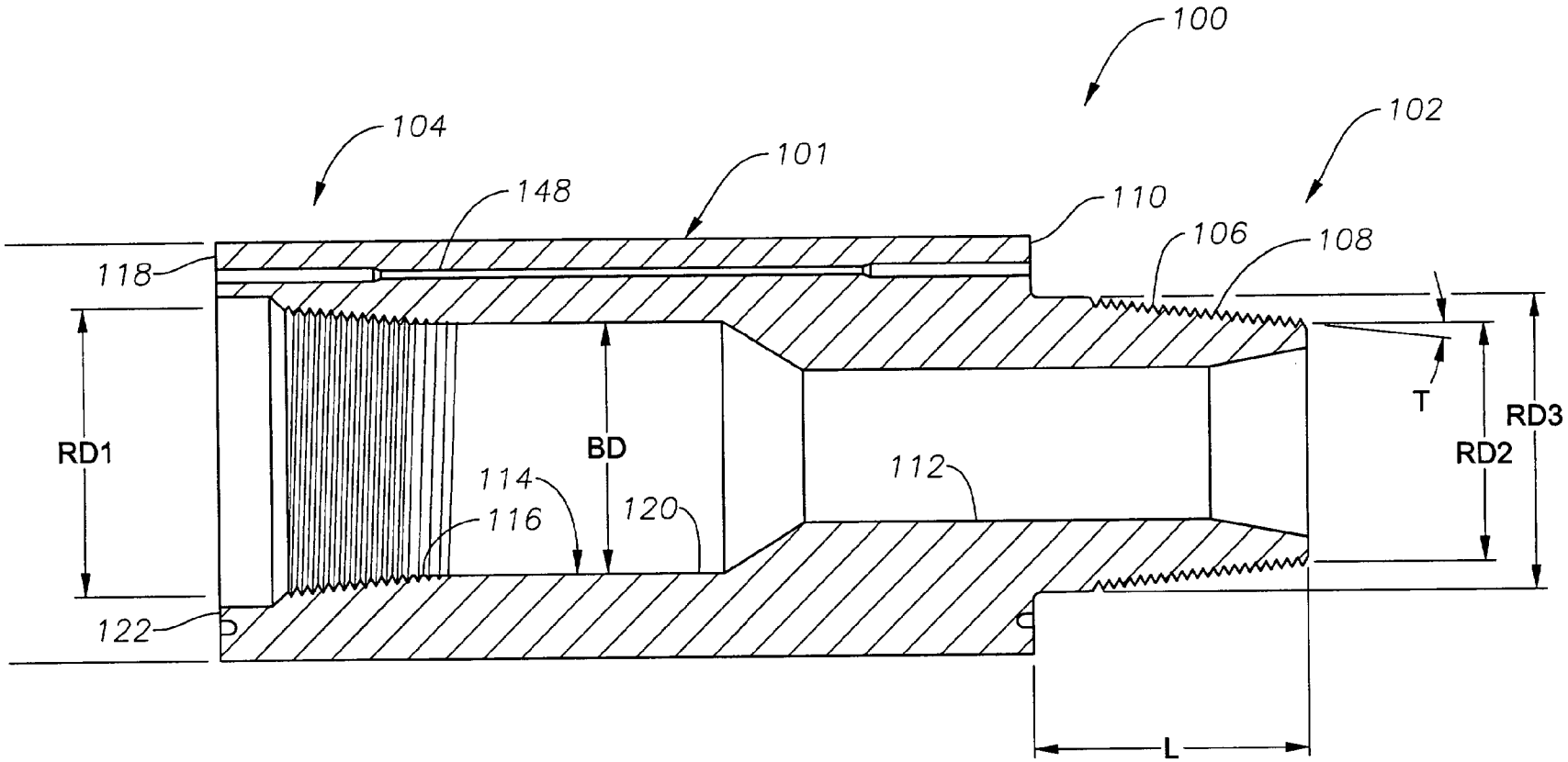
FIG. 2 shows a sectional schematic view of an exemplary connection using a preferred threaded connection.

Referring now to FIG. 2, there is shown a preferred pin-box connector arrangement 100 that may be utilized anywhere along the string 24 or within the well tool 12 to connect two adjacent members or components. The arrangement 100 may be provided on a modular connector 101 as shown or on existing components. Such components include, but are not limited to, steerable assemblies, drilling motors, bottomhole assemblies, measurement-while-drilling assemblies, formation evaluation tools, drill collars or drill pipe.

Figure 3:
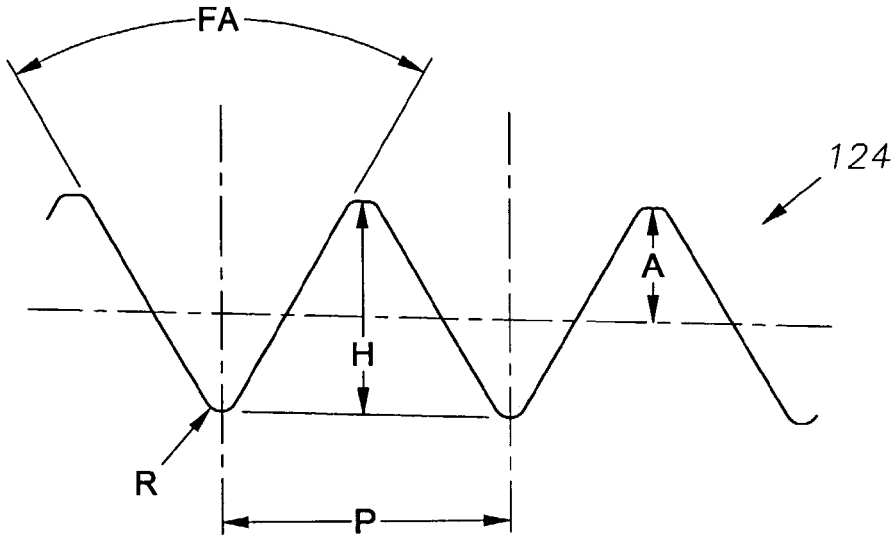
FIG. 3 illustrates an exemplary thread profile to which the teachings of the present invention may be applied.

The connector 101 includes a pin end 102 and a box end 104. The pin end 102 is generally configured to mate with a complementary box end of an adjacent component (not shown). The pin end 102 includes a nose 106 having a threaded surface 108, a shoulder 110, and a through bore 112. The box end 104 includes a stepped bore 114 having a threaded interior portion 116, a shoulder 118, and a boreback 120. Upon engagement of a pin end 102 and a box end 104, the shoulders 110 and 118 mate along a ring-like surface area. The pin threaded surface 108 and box threaded interior portion 116 each include threads 124 that are best shown in FIG. 3. The threads 124 are generally defined by a thread configuration and thread profile. The thread configuration includes reference diameters RD1 and RD2 (FIG. 2), pin length L, and bore-back diameter BD. As is known, reference diameters RD1 and RD2 establish the spatial relationship of the pin and box threads 124 during the manufacturing process and thereby ensure that these threads will properly engage during make-up. That is, RD1 defines the thread orientation for the box end 104 and RD2 define the thread orientation for the pin end 102. The pin length L and bore-back diameter as well as taper T influence, in part, the amount of material, e.g., metal, on which threads can be formed. The thread profile includes flank angle FA, taper T, pitch P, root radius R, thread height H, and thread addendum A. The above features are intended to conform to conventional thread design and nomenclature and thus will not be discussed in detail.

A preferred thread profile includes a relatively longer pitch, a relatively larger root radius and a relatively shallower taper as compared to conventional thread profile standards (e.g., API standards). For convenience, these thread profile elements or features will be discussed in terms of ratios, specifically the ratio between Pitch and Root Radius (P/R) and the ratio between Thread Height and Root Radius (H/R). The preferred thread profile may be determined by an iterative modeling process wherein one or more parameters, such as a connection outer diameter, are set as a design parameter. A first profile having a known thread design, e.g., an API specified profile is then formed on a test piece. This test piece preferably includes a controlled variation in one or more thread profile or configuration features. For example, the taper T may be made relatively shallow in order to provide more material on which to form threads in the box. Additionally, the root radius R may be increased to reduce local stress concentration. This test piece is subjected to bending fatigue under controlled conditions until the threaded connection or coupling fails. Thereafter, known methods such as mathematical models utilizing finite element analysis may be used to determine the extent to which an incremental variation in the same feature or another feature may reduce stresses. A second piece is then prepared and retested. This iterative design process can be used, for example, to isolate one or more features that can be modified to effect a reduction in localized stresses in the thread form. It will be appreciated that this mathematical modeling technique will produce (a) an thread design having one or more optimized features (i.e., maximized fatigue resistance); and/or (b) a table of various combinations of feature variations that produce a particular fatigue resistance that is greater than that of conventional thread designs.

The table below provides a comparison of a conventional thread profile and one preferred embodiment of a thread profile for a conventional connection having a 9½ inch outer diameter, a pin inner diameter of 3½ inches, and a box bore-back inner diameter of 145 mm:

| Profile Feature | Conventional Thread Profile | Preferred Thread Profile |
|---|---|---|
| Taper | 1:4 | 1:5 |
| Flank Angle | 60 deg | 50 deg |
| Pitch-to-Root Radius Ratio | 10 | 5.40 |
| Thread Height-to-Root Radius Ratio | 5.83 | 2.41 |

As can be seen, the pitch-to-root radius ratio is preferably less that that of the conventional (e.g., API) thread profile, and preferably no greater than approximately 5.40. Likewise, the thread height-to-root radius ratio is preferably less that that of the conventional (e.g., API) thread profile, and preferably no greater than approximately 2.41. The preferred thread configuration for the 9½ inch connection is as follows:

| Thread Feature | Value for 9½ inch Connector |
|---|---|
| Reference diameters RD1, RD2 | 168.30 mm (RD1)<br>143.25 mm (RD2) |

-continued

| Thread Feature | Value for 9½ inch Connector |
|---|---|
| Pin Length | 169 mm |
| Bore-back diameter | 145 mm |

Figure 4:
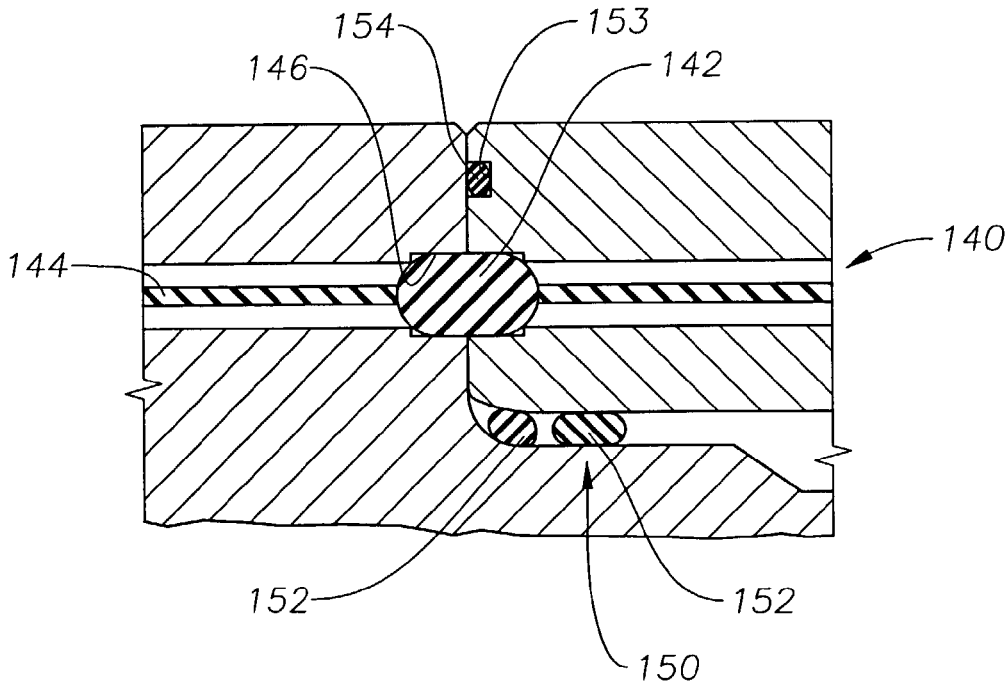
FIG. 4 schematically illustrates an optional power and data carrier and optional sealing system that may be used in conjunction with the present invention.

Referring briefly to FIG. 2, the mating area between the shoulders 110 and 118 is approximately 10,800 $mm^2$ for the preferred thread profile versus about 10,600 $mm^2$ for the conventional thread profile (in both cases including the optional grooves 146 and 153 for the power and data carrier system shown in FIG. 4).

It is believed that the above general guidelines for a preferred thread profile and configuration will enhance the fatigue strength of a connection utilizing an exemplary thread profile of the present invention. It is, for example, estimated that the comparative endurance limits for the pin and box of the conventional and preferred thread profiles under rotating bending are as follows:

| Thread Profile and | Pin | | Box | |
|---|---|---|---|---|
| Configuration | Conventional | Preferred | Conventional | Preferred |
| Maximum Rotating Bending Loading for "infinite life" | 100% | 152% | 100% | 204% |

As is known, tooling for downhole applications is provided in various diameters to accommodate the several conventional sizes of well bores. Accordingly, for convenience, the following table provides numerical guidelines for preferred thread profiles for other conventional well tool and equipment diameter sizes:

| Profile Feature | 4¾ inch | 6¾ inch | 8¼ inch |
|---|---|---|---|
| Taper | 1:8/1.5 TPF | 1:8/1.5 TPF | 1:6/2 TPF |
| Flank Angle | 60 degrees | 60 degrees | 60 degrees |
| Pitch-to-Root Radius Ratio | 5.52 | 5.29 | 5.50 |
| Thread Height-to-Root Radius Ratio | 2.28 | 2.10 | 2.25 |

Preferred thread configurations for the above listed connections or couplings are as follows:

| Thread Feature | 4¾ inch | 6¾ inch | 8¼ inch |
|---|---|---|---|
| Reference diameters RD1, RD2 | 87.96 mm (RD1) 80.79 mm (RD2) | 118.83 mm (RD1) 106.80 mm (RD2) | 143.4 mm (RD1) 125.32 mm (RD2) |
| Pin Length | 90 mm | 140 mm | 150 mm |
| Bore-back diameter | 80.5 mm | 106.5 mm | 127 mm |

Like the values stated for the 9½ inch coupling, it will be appreciated by one of ordinary skill in the art that the pitch-to-root radius ratios shown above are preferably less that that of corresponding conventional (e.g., API) thread profiles, and preferably no greater than the approximate values listed above. Likewise, the thread height-to-root radius ratios are preferably less that that of corresponding conventional (e.g., API) thread profiles, and preferably no greater than the approximate values listed above.

For convenience, selected thread profile values from the API specification are provided below in Tables A and B:

TABLE A

| Connection Number or Size | Thread Form | Threads Per Inch | Taper, Inches Per Foot on Dia |
|---|---|---|---|
| NC23 | V-0.038R | 4 | 2 |
| NC26 | V-0.038R | 4 | 2 |
| NC31 | V-0.038R | 4 | 2 |
| NC35 | V-0.038R | 4 | 2 |
| NC38 | V-0.038R | 4 | 2 |
| NC40 | V-0.038R | 4 | 2 |
| NC44 | V-0.038R | 4 | 2 |
| NC46 | V-0.038R | 4 | 2 |
| NC50 | V-0.038R | 4 | 2 |
| NC56 | V.0.038R | 4 | 3 |
| NC61 | V-0.038R | 4 | 3 |
| NC70 | V-0.038R | 4 | 3 |
| NC77 | V-0.038R | 4. | 3 |
| 2⅜ REG | V-0.040 | 5 | 3 |
| 2⅞ REG | V-0.040 | 5 | 3 |
| 3½ REG | V-0.040 | 5 | 3 |
| 4½ REG | V-0.040 | 5 | 3 |
| 5½ REG | V-0.040 | 4 | 3 |
| 6⅝ REG | V-0.050 | 4 | 2 |
| 7⅝ REG | V-0.050 | 4 | 3 |
| 8⅝ REG | V-0.050 | 4 | 3 |

TABLE B

| Thread Form | Taper, in. per ft. | Thread Height, Truncated $H_n = h_a$ | Root Radius $r_m = r_{rs}$ |
|---|---|---|---|
| V-0.038R | 2 | 0.121844 | 0.038 |
| V-0.038R | 3 | 0.121381 | 0.038 |
| V-0.040 | 3 | 0.117842 | 0.020 |
| V.0.050 | 3 | 0.147303 | 0.025 |
| V-0.050 | 2 | 0.147804 | 0.025 |
| V-0.065 | 2 | 0.111459 | — |

Table A reproduces selected numbers from Table 9.1 entitled Product Dimensions Rotary Shouldered Connections and Table B reproduces selected numbers from Table 9.2 entitled Product Thread Dimensions Rotary Shouldered Connection, both of which are found in *Specification for Rotary Drilling Equipment* (American Petroleum Institute) Specification 7 (SPEC 7) Thirty-Seventh Edition, Aug. 1, 1990 by the American Petroleum Institute, a reference which is hereby incorporated by reference for the purpose of defining conventional thread specifications.

It will be apparent that the embodiments of the present invention use dimensions for the above-described features that are different from those currently specified by the American Petroleum Institute (API) and that provide markedly improved strength characteristics. Generally, when compared to the corresponding conventional connection size, the embodiments of the present invention include: (i) a pitch-to-root radius ratio that is less than the API ratios (which is approximately 8 to 10), e.g., less than 6.5 to 7; (ii) a thread height-to-root radius ratio that is less than that specified by the API (which is approximately 4 to 6), e.g., less than 3.5; (iii) a flank angle that is less than that specified by the API (which is approximately 60°) and (iv) a taper that is less than that specified by the API (which runs from 1:4 to 1:8). It should be understood, however, that a coupling having less than all of these features may, in many instances, provide adequate strength characteristics.

It should be appreciated that these values are provided with specificity merely for convenience and that the present invention is by no means limited to these values. Furthermore, it should be understood that these values are subject to applicable machining tolerances. Thus, these values merely indicate the general optimization technique that may be applied to minimize local stresses under given geometric constraints. It is believed that the general relationships between the described features of the thread profile will enhance the fatigue strength of nearly any diameter size connection utilizing an exemplary thread profile of the present invention.

In alternative embodiments to the present invention, the threads may be cold worked to increase of fatigue resistance, copper plated to increase of galling resistance, and/or shot peened to increase resistance against stress/corrosion/cracking. The threads may also include stress relief groove(s) to increase of fatigue resistance.

Referring now to FIGS. 2 and 4, there are shown an optional power and data carrier 140 and an optional sealing system 150. The power and data carrier 140 transmits electrical power and data along the well tool 12 and/or the string 24 (FIG. 1). The carrier 140 includes a contact ring 142, wiring 144 and insulation (not shown). Not shown but also included may be a contact spring and a pressure seal plug. The connector 101 may be modified to include an annular groove 146 for receiving the contact ring 142 and a conduit 148 through which the wiring 144 may pass. Suitable insulation may be provided to prevent protect the wiring 144 and contact ring 142. The optional sealing system 150 may include seals 152 that are disposed around the pin nose proximate to the shoulder as well as an annular groove 153 and a seal ring 154 in shoulder 118 or 110 to prevent drilling fluid or other well bore fluids from reaching the wiring.

It will be appreciated that the preferred threaded connection will enhance the utility of threadedly joined components or members of well tools and strings used in a well construction system. For example, a bottomhole assembly utilizing one or more preferred connections will have improved resistance to fatigue imposed during harsh drilling conditions, high cyclic or dynamic loading. Such a bottomhole assembly will allow a relatively longer time in rotation within curved boreholes and effect higher build-up rate or dogleg severity.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A connector for use in oilfield applications, comprising:

(a) a first member having a pre-determined outside diameter and a nose, said nose having external threads formed thereon;

(b) a second member having a box end provided with internal threads that mate with said external threads;

wherein said internal threads and said external thread have a flank angle greater than 50 degrees; and a taper that is between approximately 1:4 to 1:14; and wherein said internal threads and said external threads have one of: (i) pitch-to-root radius ratio that is less than 6.5; and (ii) a thread height-to-root radius ratio that is less than 3.5.

2. The connector of claim 1 wherein said internal threads and said external threads have one of: (i) a pitch-to-root radius ratio of no greater than approximately 5.40; and (ii) a thread height-to-root radius ratio of no greater than approximately 2.41.

3. The connector of claim 1 wherein said internal threads and said external threads have one of: (i) a pitch-to-root radius ratio of approximately 5.40; and (ii) a thread height-to-root radius ratio of approximately 2.41.

4. The connector of claim 1 wherein said internal threads and said external threads have one of: (i) a pitch-to-root radius ratio of no greater than approximately 5.52; and (ii) a thread height-to-root radius ratio of no greater than approximately 2.28.

5. The connector of claim 1 wherein said internal threads and said external threads have one of: (i) a pitch-to-root radius ratio of approximately 5.52; and (ii) a thread height-to-root radius ratio of approximately 2.28.

6. The connector of claim 1 wherein said internal threads and said external threads have one of: (i) a pitch-to-root radius ratio of no greater than approximately 5.29; and (ii) a thread height-to-root radius ratio of no greater than approximately 2.10.

7. The connector of claim 1 wherein said internal threads and said external threads have one of: (i) a pitch-to-root radius ratio of approximately 5.29; and (ii) a thread height-to-root radius ratio of approximately 2.10.

8. The connector of claim 1 wherein said internal threads and said external threads have one of: (i) a pitch-to-root radius ratio of no greater than approximately 5.50; and (ii) a thread height-to-root radius ratio of no greater than approximately 2.25.

9. The connector of claim 1 wherein said internal threads and said external threads have one of: (i) a pitch-to-root radius ratio of approximately 5.29; and (ii) a thread height-to-root radius ratio of approximately 2.10.

10. A method for coupling a first and second member disposed along a work string adapted for use in a wellbore, comprising:

(a) providing the first member with a pre-determined outside diameter and a nose, the nose having external threads formed thereon; and (b) providing a second member with a box end having internal threads that mate with the external threads;

wherein said internal threads and said external thread have a flank angle between approximately 50 degrees and approximately 80 degrees; and a taper that is between approximately 1:4 to 1:14; and wherein the internal threads and the external threads have one of: (i) pitch-to-root radius ratio that is less than approximately 6.5; (ii) a thread height-to-root radius ratio that is less than approximately 3.5.

11. The method according to claim 10 wherein the internal threads and the external threads have one of: (i) a pitch-to-root radius ratio of no greater than approximately 5.40; and (ii) a thread height-to-root radius ratio of no greater than approximately 2.41.

12. The method according to claim 10 wherein the internal threads and the external threads have one of: (i) a pitch-to-root radius ratio of approximately 5.40; and (ii) a thread height-to-root radius ratio of approximately 2.41.

13. The method according to claim 10 wherein the internal threads and the external threads have one of: (i) a pitch-to-root radius ratio of no greater than approximately 5.52; and (ii) a thread height-to-root radius ratio of no greater than approximately 2.28.

14. The method according to claim 10 wherein the internal threads and the external threads have one of: (i) a pitch-to-root radius ratio of approximately 5.52; and (ii) a thread height-to-root radius ratio of approximately 2.28.

15. The method according to claim 10 wherein the internal threads and the external threads have one of: (i) a pitch-to-root radius ratio of no greater than approximately 5.29; and (ii) a thread height-to-root radius ratio of no greater than approximately 2.10.

16. The method according to claim 10 wherein the internal threads and the external threads have one of: (i) a pitch-to-root radius ratio of approximately 5.29; and (ii) a thread height-to-root radius ratio of approximately 2.10.

17. The method according to claim 10 wherein the internal threads and the external threads have one of: (i) a pitch-to-root radius ratio of no greater than approximately 5.50; and (ii) a thread height-to-root radius ratio of no greater than approximately 2.25.

18. The method according to claim 10 wherein the internal threads and the external threads have one of: (i) a pitch-to-root radius ratio of approximately 5.29; and (ii) a thread height-to-root radius ratio of approximately 2.10.

19. A connector for use in oilfield applications, comprising:

(a) a first member having a pre-determined outside diameter and a nose, the nose having external threads formed thereon;

(b) a second member having a box end provided with internal threads that mate with the external threads, wherein the internal threads and the external threads are defined by: (i) a pitch-to-root radius ratio between approximately 5.29 to 5.52; (ii) a thread height-to-root radius ratio between approximately 2.10 to 2.41; (iii) a flank angle that is between approximately 50 degrees to 60degrees; and (iv) a taper that is between approximately 1:5 to 1:8.

20. A connector for use in oilfield applications, comprising:

(a) a first member having a pre-determined outside diameter and a nose, the nose having external threads formed thereon;

(b) a second member having a box end provided with internal threads that mate with the external threads, the internal threads and the external threads being defined by: (i) a pitch-to-root radius ratio that is less than specified by the American Petroleum Institute (API); (ii) a thread height-to-root radius ratio that is less than that specified by the API; (iii) a flank angle that is less than that specified by the API; and (iv) a taper that is less than that specified by the API for the pre-determined outside diameter, the internal threads and the external threads being further defined by: (i) a taper less than 1:5; (ii) a flank angle-less than approximately 50 degrees; (iii) a pitch-to-root radius ratio of no greater than approximately 5.40; and (iv) a thread height-to-root radius ratio of no greater than approximately 2.41.

21. A connector for use in oilfield applications, comprising:

(a) a first member having a pre-determined outside diameter and a nose, the nose having external threads formed thereon;

(b) a second member having a box end provided with internal threads that mate with the external threads, the internal threads and the external threads being defined by: (i) a pitch-to-root radius ratio that is less than specified by the American Petroleum Institute (API); (ii) a thread height-to-root radius ratio that is less than that specified by the API; (iii) a flank angle that is less than that specified by the API; and (iv) a taper that is less than that specified by the API for the pre-determined outside diameter, the internal threads and the external threads being defined further by: (i) a taper less than 1:8; (ii) a flank angle less than approximately 60 degrees; (iii) a pitch-to-root radius ratio of no greater than approximately 5.52; and (iv) a thread height-to-root radius ratio of no greater than approximately 2.28.

22. A connector for use in oilfield applications, comprising:

(a) a first member having a pre-determined outside diameter and a nose, the nose having external threads formed thereon;

(b) a second member having a box end provided with internal threads that mate with the external threads, the internal threads and the external threads being defined by: (i) a pitch-to-root radius ratio that is less than specified by the American Petroleum Institute (API); (ii) a thread height-to-root radius ratio that is less than that specified by the API; (iii) a flank angle that is less than that specified by the API; and (iv) a taper that is less than that specified by the API for the pre-determined outside diameter, the internal threads and the external threads being defined by: (i) a taper less than 1:8; (ii) a flank angle than approximately 60 degrees; (iii) a pitch-to-root radius ratio of no greater than approximately 5.29; and (iv) a thread height-to-root radius ratio of no greater than approximately 2.10.

23. A connector for use in oilfield applications, comprising:

a first member having a pre-determined outside diameter and a nose, the nose having external threads formed thereon;

(b) a second member having a box end provided with internal threads that mate with the external threads, the internal threads and the external threads being defined by: (i) a pitch-to-root radius ratio that is less than specified by the American Petroleum Institute (API); (ii) a thread height-to-root radius ratio that is less than that specified by the API; (iii) a flank angle that is less than that specified by the API; and (iv) a taper that is less than that specified by the API far the pre-determined outside diameter, the internal threads and the external threads being further defined by: (i) a taper less than 1:6; (ii) a flank angle than approximately 60 degrees; (iii) a pitch-to-root radius ratio of no greater than approximately 5.50; and (iv) a thread height-to-root radius ratio of no greater than approximately 2.25.

24. A connector for use in oilfield applications, comprising:

(a) a first member having a pre-determined outside diameter and a nose, the nose having external threads formed thereon;

(b) a second member having a box end provided with internal threads that mate with the external threads, the internal and external threads being defined by: (i) a pitch-to-root radius ratio between 4.5 to 6; (ii) a thread height-to-root radius ratio between 1.75 to 2.75; and (iii) a taper that is between 1:4 to 1:14.

25. The connector of claim 24 wherein the internal threads and the external threads being further defined by: (i) the taper at least as shallow as 1:5; (ii) a flank angle no greater than approximately 50 degrees; (iii) the pitch-to-root radius ratio of no greater than approximately 5.40; and (iv) the thread height-to-root radius ratio of no greater than approximately 2.41.

26. The connector of claim 24 wherein the internal threads and the external threads being defined further by: (i) the taper at least as shallow as 1:8; (ii) a flank angle no greater than approximately 60 degrees; (iii) the pitch-to-root radius ratio of no greater than approximately 5.52; and (iv) the thread height-to-root radius ratio of no greater than approximately 2.28.

27. The connector of claim 24 wherein the internal threads and the external threads being defined by: (i) the taper at least as shallow as 1:8; (ii) a flank angle no greater than approximately 60 degrees; (iii) the pitch-to-root radius ratio of no greater than approximately 5.29; and (iv) the thread height-to-root radius ratio of no greater than approximately 2.10.

28. The connector of claim 24 wherein the internal threads and the external threads being defined by: (i) the taper at least as shallow as 1:6; (ii) a flank angle no greater than approximately 60 degrees; (iii) the pitch-to-root radius ratio of no greater than approximately 5.50; and (iv) the thread height-to-root radius ratio of no greater than approximately 2.25.

* * * * *